US005156313A

United States Patent [19]

Smart et al.

[11] Patent Number: 5,156,313

[45] Date of Patent: Oct. 20, 1992

[54] RIVET SETTING TOOL

[75] Inventors: Charles F. Smart, Danbury; Anthony D'Aquila, Trumbull, both of Conn.

[73] Assignee: Emhart Industries, Inc., Towson, Md.

[21] Appl. No.: 630,614

[22] Filed: Dec. 20, 1990

Related U.S. Application Data

[63] Continuation of Ser. No. 564,177, Aug. 3, 1990, abandoned.

[51] Int. Cl.[5] ..... B23P 11/00

[52] U.S. Cl. ..... 227/8; 227/51; 29/243.53

[58] Field of Search ..... 227/2, 4, 5, 6, 7, 8, 227/51, 52, 53, 54, 55, 60; 29/243.53, 243.54

[56] References Cited

U.S. PATENT DOCUMENTS

| | | | |
|---|---|---|---|
| 2,963,707 | 12/1960 | Schulz | 227/8 |
| 3,436,004 | 4/1969 | Morabito et al. | 227/7 |
| 4,183,239 | 1/1980 | Stubbings | 72/391 |
| 4,512,070 | 4/1985 | Anhalt | 29/243.53 |
| 4,566,182 | 1/1986 | Altwicker | 29/243.53 |
| 4,579,109 | 7/1988 | Mason et al. | 227/51 |

*Primary Examiner*—Frank T. Yost
*Assistant Examiner*—Allan M. Schrock
*Attorney, Agent, or Firm*—Spencer T. Smith

[57] ABSTRACT

A rivet tool is supported for repeated displacement to a rivet setting location. When the tool is at this location, it is forcefully pushed against the workpiece during rivet setting to assure that the rivet will be properly set.

3 Claims, 1 Drawing Sheet

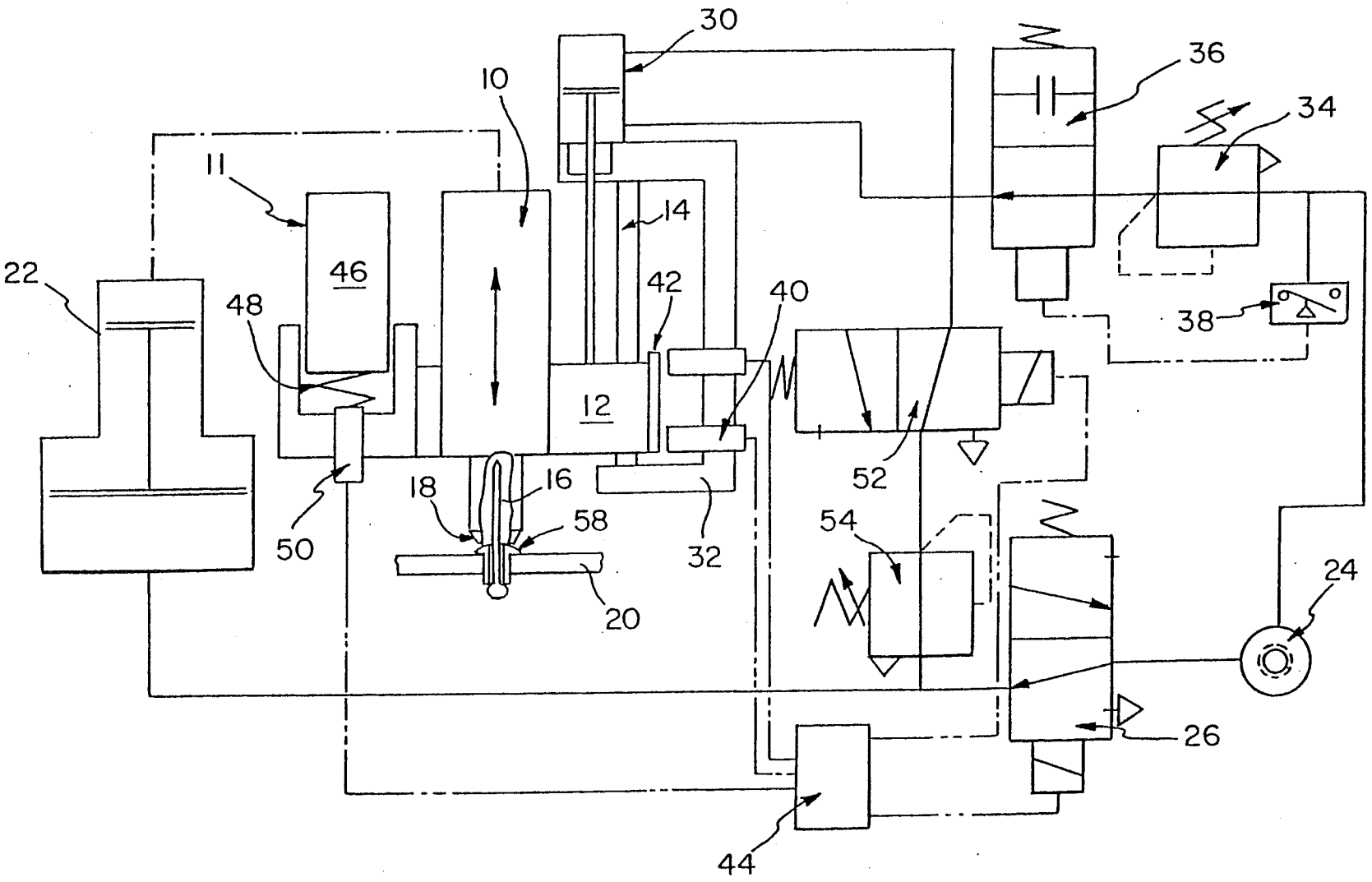
34
36
38
24
26
52
54
40
30
14
42
12
32
44
10
16
58
20
18
46
50
48
11
22

RIVET SETTING TOOL

This is a continuation of co-pending application Ser. No. 564,177 filed on Aug. 3, 1990, now abandoned.

The present invention relates to automatic rivet setting tools.

One of the major reasons why riveted assemblies are rejected is that a rivet has not been adequately seated. This occurs when an operator, in his haste to improve throughput, sets the rivet when he is retracting the rivet setting tool from the contact surface.

It is accordingly an object of the present invention to guarantee intimate contact with positive interface pressure between the rivet flange and the parts to be assembled prior to upsetting the rivet.

Other objects and advantages of the present invention will become apparent from the following portion of the specification and from the accompanying drawings, which illustrate, in accordance with the mandate of the patent statutes, a presently preferred embodiment of the invention.

Referring to the drawings:

The sole drawing is a schematic representation of an automatic rivet setting tool made in accordance with the teachings of the present invention.

The rivet setting pulling head 10 of a rivet setting tool is secured to a support bracket 12 which is vertically displaceable up and down a guide rod or rods 14. The pulling head can be lowered to set or fasten a rivet 16 held in the nose 18 of the pulling head to a workpiece 20. The pulling head is operated by a hydraulic/-pneumatic intensifier 22 which intensifies the pressure of air supplied from a conventional source 24. This intensifier will operate whenever a first pneumatic solenoid valve 26 is operated.

The weight of the pulling head 10, handle assembly 11 and bracket 12 are counterbalanced by a double acting cylinder 30 (or more than one) which is located between the support bracket 12 and the machine base 32. Air under pressure is supplied from the source 24 through a precision pressure regulator 34 to the bottom of the cylinder 30 and is adjusted to counterbalance the system. Failsafe operation is assured by use of a normally closed, two way, spring return solenoid valve 36 which will close locking the movement of the cylinder whenever power is lost or pressure switch 38 senses a loss of pressure.

To assure that the rivet will be properly set, a pair of proximity switches 40 operate with an adjustable target 42 to signal the controller 44 when the pulling head is at the fully down, rivet setting position. As can be seen from the drawing, the handle 46 of the handle assembly 11 used by the operator to pull the pulling head down to the rivet setting position is spring 48 loaded. This spring is sufficiently strong that during movement of the pulling head there is no movement of the handle relative to the pulling head. To operate the rivet tool following the arrival of the pulling head at the rivet setting position, the operator must compress this spring causing relative movement between the handle and the pulling head, until the proximity switch 50 issues a signal to the controller. With all three proximity switch (40, 40, 50) signals received by the controller the controller will open the first pneumatic cylinder 26 to operate the pulling head and will simultaneously operate a third pneumatic solenoid 52, which is normally positioned to exhaust the top of the cylinder, to supply air at a desired pressure controlled by a second precision pressure regulator 54 to the top of the cylinder to hold the rivet flange 58 against the workpiece 20. The controller includes a timer which controls how long the pulling head is operated and the cylinder holds the pulling head down. With the timing out of this timer, the second 36 and third 52 solenoid valves return to closed position allowing the operator to raise the rivet tool. The two proximity switches 40 also verify that the assembly contains the proper number of pieceparts to be riveted together which would control the proper location of the pulling head at the rivet setting position.

What is claimed is:

1. A rivet setting tool for setting a rivet in a workpiece comprising a rivet setting pulling head including means for holding a rivet and means for setting a rivet held by said holding means, hand grippable handle means, means for mounting said handle means on said rivet setting pulling head so that said handle means will be maintained at a selected location relative to said rivet setting pulling head during displacement of said rivet setting pulling head towards a workpiece to be riveted and so that said handle means can be displaced relative to said rivet setting pulling head when a rivet held by said holding means is held against the workpiece, and switch means operable by said handle when said handle has been displaced a selected distance relative to said rivet setting pulling head for actuating said setting means.

2. A rivet setting tool according to claim 1 wherein said handle is displacement relative to said pulling head in a direction parallel to the axis of a rivet held in said pulling head.

3. A rivet setting tool according to claim 2, wherein said maintaining and permitting means comprises a compressible spring.

* * * * *